US011643813B2

(12) United States Patent
McDonald

(10) Patent No.: US 11,643,813 B2
(45) Date of Patent: May 9, 2023

(54) TELESCOPING WALL

(71) Applicant: SKYFOLD INC., Baie-d'Urfé (CA)

(72) Inventor: Mark McDonald, Beaconsfield (CA)

(73) Assignee: SKYFOLD INC., Baie-d'Urfe (CA)

( * ) Notice: Subject to any disclaimer, the term of this patent is extended or adjusted under 35 U.S.C. 154(b) by 23 days.

(21) Appl. No.: 17/147,977

(22) Filed: Jan. 13, 2021

(65) Prior Publication Data

US 2021/0214938 A1 Jul. 15, 2021

Related U.S. Application Data

(60) Provisional application No. 62/960,354, filed on Jan. 13, 2020.

(51) Int. Cl.

| | |
|---|---|
| ***E04B 1/343*** | (2006.01) |
| ***E04B 2/82*** | (2006.01) |
| ***E04B 2/72*** | (2006.01) |
| ***E04B 2/74*** | (2006.01) |

(52) U.S. Cl.
CPC ..... *E04B 2/827* (2013.01); *E04B 2/721* (2013.01); *E04B 2/7401* (2013.01)

(58) Field of Classification Search
CPC ..... E04B 1/34305; E04B 2/827; E04B 2/82; E04B 2/721; E05Y 2800/122; E05Y 2900/14; E06B 3/922; E06B 3/921
See application file for complete search history.

(56) References Cited

U.S. PATENT DOCUMENTS 3,491,483 A * 1/1970 Miller ..... E05D 15/58 49/141
3,871,133 A * 3/1975 Ellingson, Jr. ..... E06B 7/2316 49/470
3,960,196 A * 6/1976 Berner ..... E06B 3/921 160/202
4,020,595 A * 5/1977 Duncan ..... E06B 7/18 49/470
4,103,463 A * 8/1978 Dixon ..... E05D 15/0613 52/143
4,785,590 A * 11/1988 Jones ..... E04B 1/34305 52/64
6,276,092 B1 * 8/2001 Neo ..... E05D 15/0604 49/176

(Continued)

FOREIGN PATENT DOCUMENTS

| | | |
|---|---|---|
| DE | 20200428 | 5/2003 |
| WO | 2011027377 | 3/2011 |
| WO | 2018163029 | 9/2018 |

OTHER PUBLICATIONS

Extended European Search Report dated Jun. 9, 2021 for Application No. 21151263.7.

*Primary Examiner* — Brian E Glessner
*Assistant Examiner* — Daniel J Kenny
(74) *Attorney, Agent, or Firm* — Norton Rose Fulbright Canada

(57) ABSTRACT

A collapsible wall for covering an opening in a structure when the collapsible wall is in an extended position. The collapsible wall including a plurality of frame sections engaged with each other to form a telescoping frame movable between the extended position and a retracted position, the frame sections forming at least a portion of a face of the collapsible wall and defining an aperture through the face. A panel is removably engaged to the frame sections, the panel covering the aperture when the panel is disposed in a closed position.

18 Claims, 18 Drawing Sheets

(56) References Cited

U.S. PATENT DOCUMENTS

| | | | | |
|---|---|---|---|---|
| 6,860,311 | B1 * | 3/2005 | Minor | E05D 15/18 160/202 |
| 8,511,015 | B2 * | 8/2013 | Behrens | E04B 2/827 49/501 |
| 8,707,632 | B2 * | 4/2014 | Forsland | E04B 7/166 52/79.5 |
| 9,915,062 | B2 * | 3/2018 | Forsland | E04B 1/34368 |
| 10,246,931 | B2 * | 4/2019 | McKenna | E05D 15/18 |
| 11,002,064 | B2 * | 5/2021 | Hall | E04B 1/34363 |
| 11,193,272 | B2 * | 12/2021 | Milo | E04H 17/165 |
| 2004/0049984 | A1 * | 3/2004 | Pfaff | E05F 17/00 49/73.1 |
| 2019/0169899 | A1 * | 6/2019 | Miksza | E05D 15/08 |
| 2020/0040571 | A1 * | 2/2020 | Milo | E04H 17/168 |

* cited by examiner

TELESCOPING WALL

CROSS-REFERENCE

The present application claims priority on U.S. Patent Application No. 62/960,354 filed Jan. 13, 2020, the entire contents of which are incorporated herein by reference.

TECHNICAL FIELD

This disclosure relates to wall partitions and more particularly to vertically collapsible wall partitions.

BACKGROUND

Prior art vertically collapsible wall partitions exist, and are generally suitable for their intended purposes. For example, prior art vertically collapsible wall partitions typically employ a number of telescoping elements that slide relative to one another to provide for the wall functionality. However, such prior art walls have drawbacks. For example, some have relatively complex constructions. As another example, some are relatively difficult to service. Yet other drawbacks also exist.

Therefore, improvements to prior art collapsible walls are sought.

SUMMARY

In accordance with one aspect, there is accordingly provided a collapsible wall, comprising: a plurality of frame sections engaged with each other to form a telescoping frame movable between an extended position and a retracted position, the frame sections forming at least a portion of a face of the collapsible wall and defining an aperture through the face; and a panel removably engaged to the frame sections, the panel covering the aperture when the panel is disposed in a closed position.

The collapsible as described herein wall may also comprise, in whole or in part, and in any combination, one or more of the following further features.

The panel is displaceable between the closed position and an open position at least when the frame sections are in an extended position, the panel in the open position providing access into at least one of the frame sections via the aperture.

At least a part of the panel is one of transparent and translucent, and the aperture occupies a majority of an area of the face.

The face is two opposed faces of the collapsible wall, and the panel is two panels, one of the two panels covering the aperture at one of the two opposed faces and the other of the two panels covering the aperture at other of the two opposed faces.

The panel includes a panel frame removably engaged to the frame sections and a transparent or translucent portion engaged to the panel frame.

The panel is made at least substantially entirely of a transparent or translucent material.

The panel is removably engaged to the frame sections via a hinge so as to be pivotable between the closed position and the open position.

The hinge is a plurality of hinges including a first hinge at one of top lateral edges of the panel and a second hinge at the other one of top lateral edges of the panel.

Each of the hinges includes a male hinge member extending from one of the panel and at least one of the frame sections and a female hinge member defined in the other one of the panel and the at least one of the frame sections, the female hinge member being disengageable from the male hinge member at least when the panel is in the open position.

The panel is one of a plurality of panels of the collapsible wall, and each given panel of the plurality of panels is removably engaged to a given frame section of the plurality of frame sections.

A structure defining an opening therein and comprising the above-defined collapsible wall, the collapsible wall sized to cover at least a majority of the opening when the telescoping frame is in the extended position.

A recess defined in a top of the opening and being open downward into the opening, and wherein a top frame section of the plurality of frame sections is movable between a retracted position in which the top frame section is received at least in part within the recess, and an extended position in which the top frame section extends downward out of the recess into the opening.

A sheave system connecting the collapsible wall to the structure, the sheave system operable to move the telescoping frame between its extended position in which the collapsible wall covers at least the majority of the opening, and the retracted position in which the collapsible wall exposes at least another majority of the opening.

Each frame section of the plurality of frame sections includes side seals slidably engaging respective lateral sides of the opening.

The side seals are biased toward the respective lateral sides of the opening.

At least one of the side seals includes arcuate portions slidably contacting a respective one of the lateral sides of the opening.

At least one of the side seals includes a movable member engaged to a respective side of a respective one of the frame sections via a biasing mechanism.

A recess defined in a bottom of the opening and being open upward into the opening, and wherein a bottom frame section of the plurality of frame sections is movable between a retracted position in which the bottom frame section is received at least in part within the recess, and an extended position in which the bottom frame section extends upward out of the recess into the opening.

In the extended position the plurality of frame sections is extended upward and covers at least a major part of the opening.

In the extended position the plurality of frame sections is extended upward and covers at least a substantial part of the opening.

The plurality of frame sections forms a plurality of telescoping vertical assemblies.

The plurality of telescoping vertical assemblies is a plurality of independent telescoping vertical assemblies.

The independent telescoping vertical assemblies are interconnected by the panels.

Many further features and combinations thereof concerning the present improvements will appear to those skilled in the art following a reading of the instant disclosure.

BRIEF DESCRIPTION OF THE DRAWINGS

FIG. 3 shows multiple schematic views of the telescoping wall attached to a structure to selectively cover an opening in the structure, the telescoping wall being in a retracted position;

FIG. 6 shows multiple schematic views of frame sections of the telescoping wall, with panels of the telescoping wall removed therefrom;

DETAILED DESCRIPTION

Figure 1B:
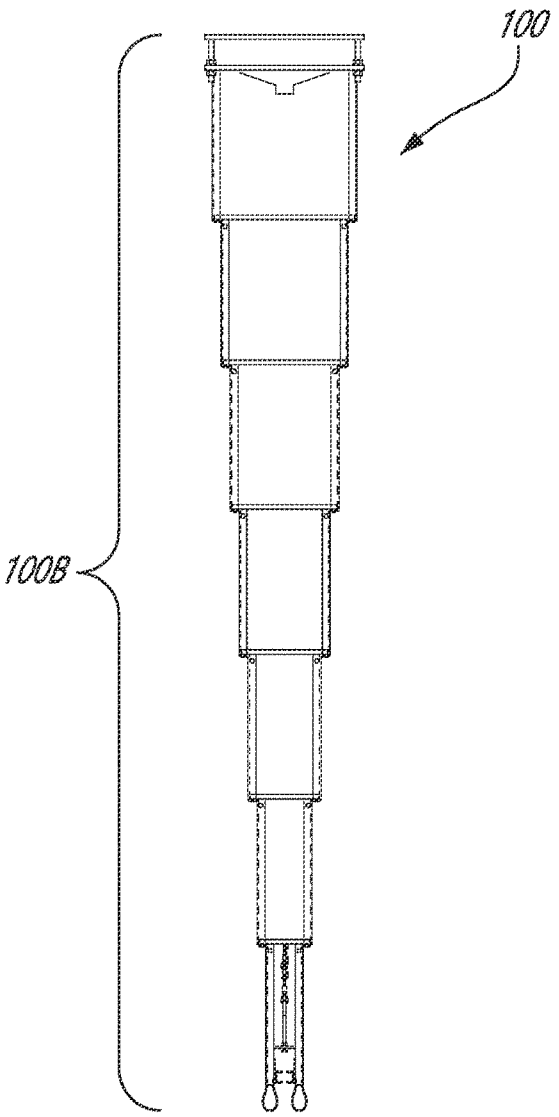
FIGS. 1A and 1B show a perspective view and a side elevation view of an embodiment of a telescoping wall of the present disclosure, the telescoping wall being in an extended position.

In the description that follows, various features have been described and labeled in the figures. Where more than one of a given feature is present, one or more of but not necessarily all of these features are labeled, to reduce repetition of reference numerals and hence to maintain clarity of the figures.

Figure 1A:
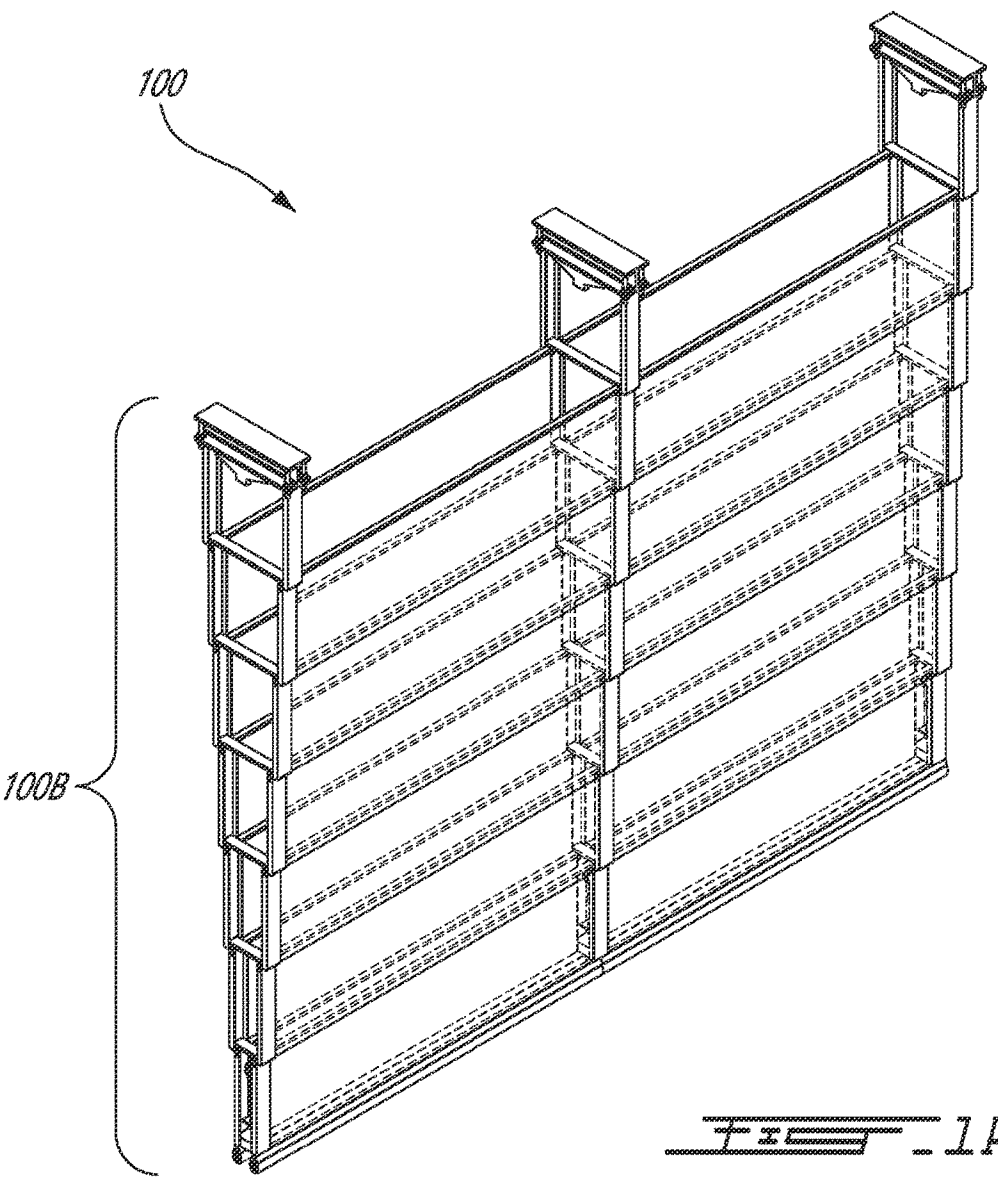
Figure 2B:
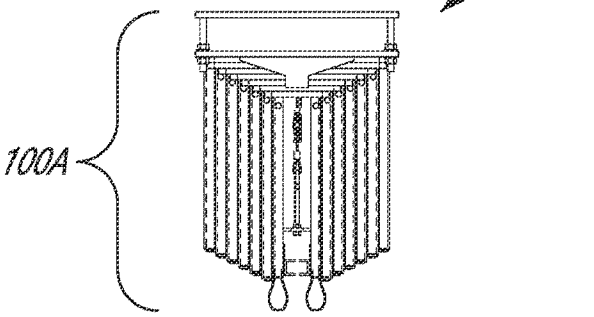
FIGS. 2A and 2B show a perspective view and a side elevation view of the telescoping wall of FIGS. 1A-1B, the telescoping wall being in a retracted position.
Figure 2A:
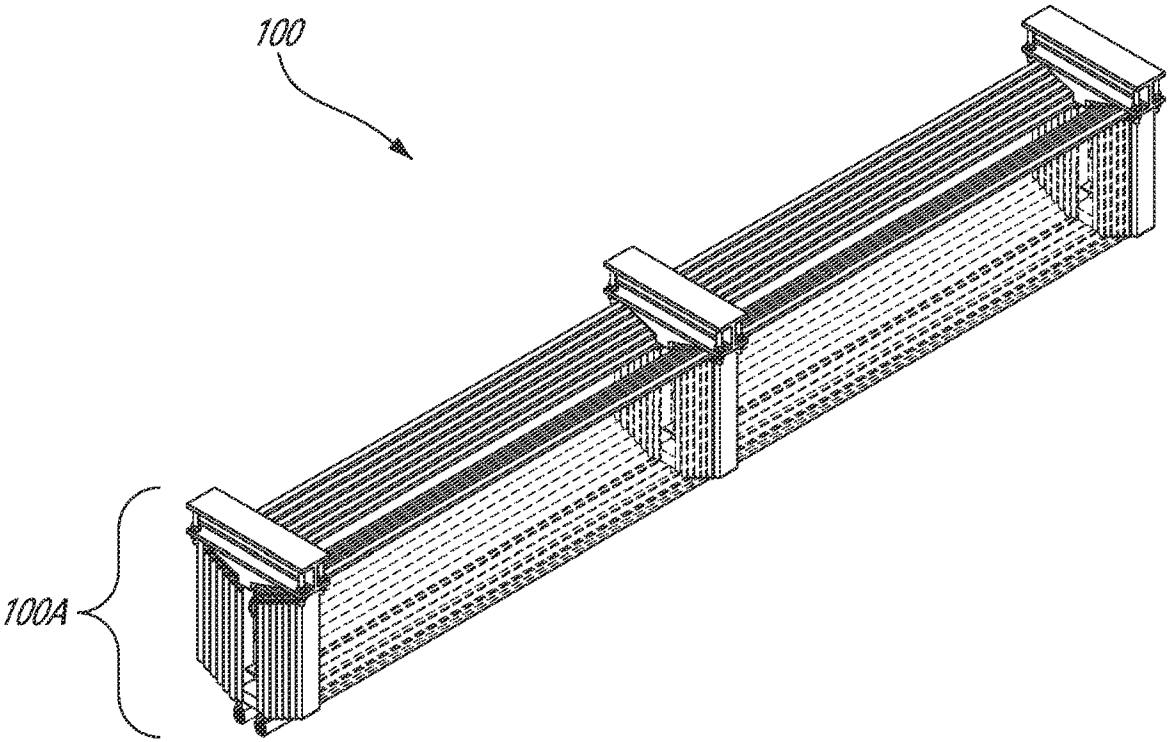

Referring to FIGS. 1A to 6, a telescoping wall 100 in accordance with an embodiment the present disclosure is operable displace between an extended position 100B (as shown in FIGS. 1A and 1B) and a retracted position 100A (as shown in FIGS. 2A and 2B). As seen in FIG. 3, the telescoping wall 100 selectively exposes at least a majority of an opening (O) in a structure (S) when in the retracted position 100A, and covers at least a majority, and in this embodiment at least a substantial part, of the opening (O) when in the extended position 100B.

Figure 4A:
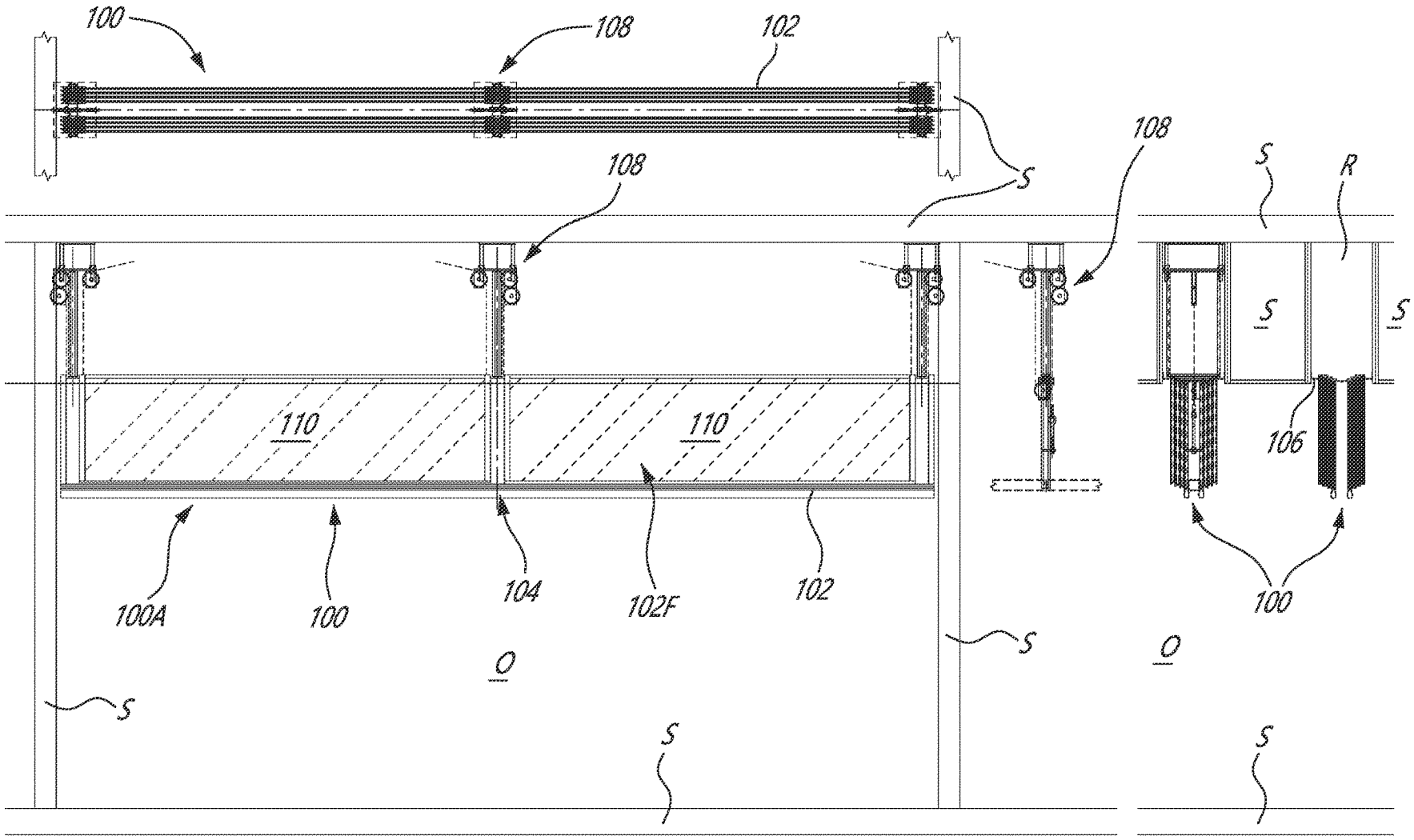
FIG. 4A shows multiple schematic views of the telescoping wall, the telescoping wall being in an intermediate position.
Figure 4B:
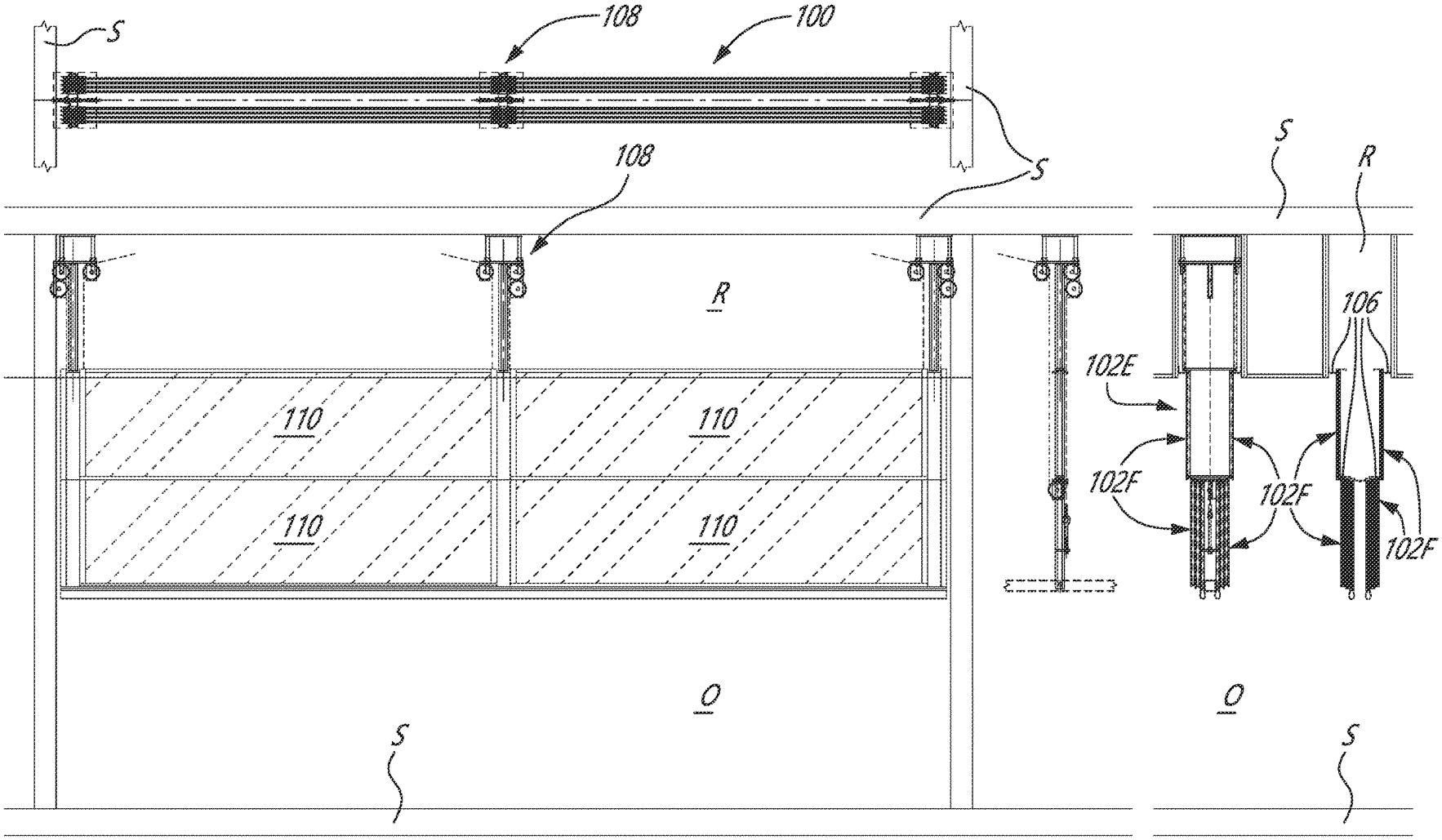
FIG. 4B shows multiple schematic views of the telescoping wall, the telescoping wall being in another intermediate position.
Figure 4C:
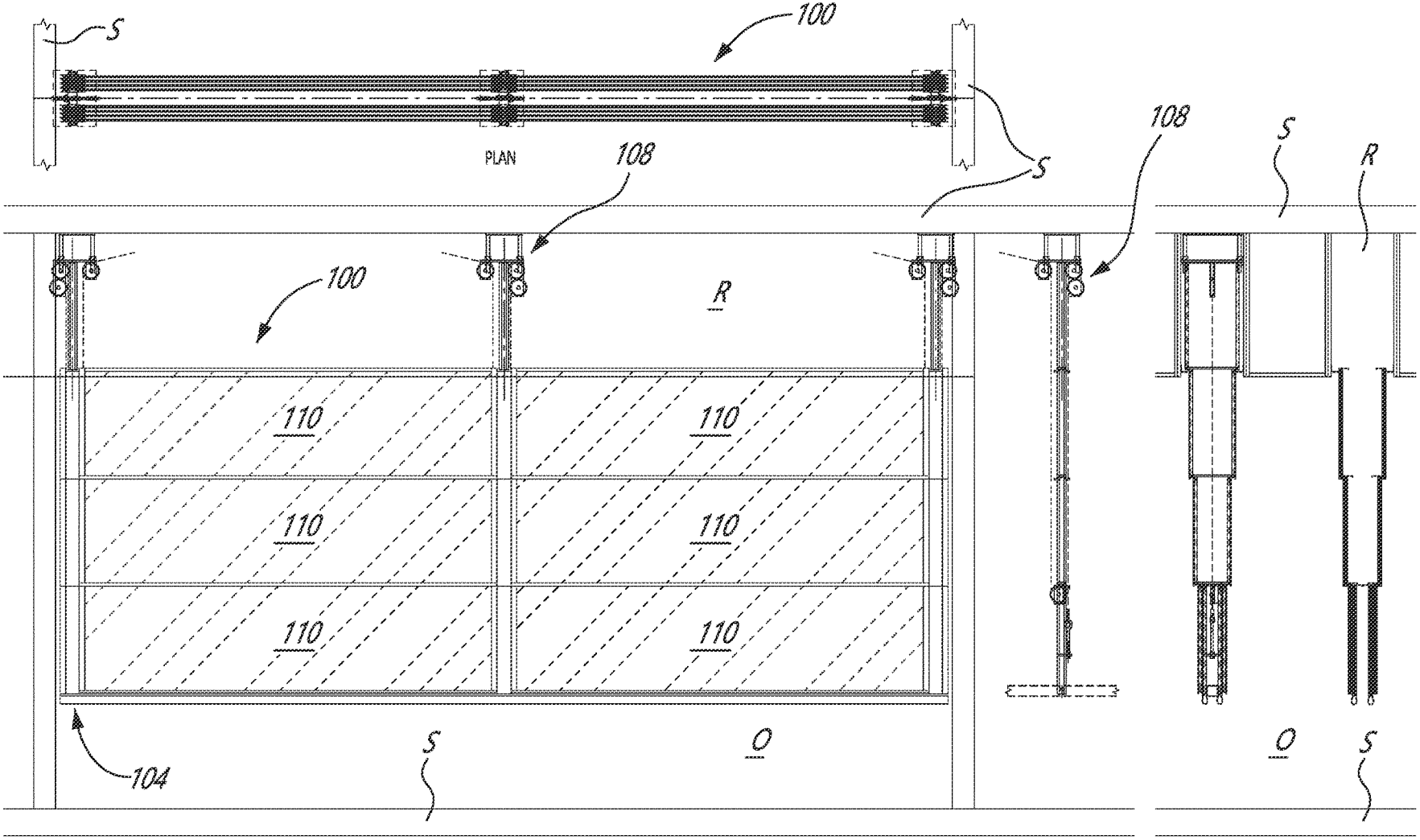
FIG. 4C shows schematic multiple views of the telescoping wall, the telescoping wall being in another intermediate position.
Figure 5:
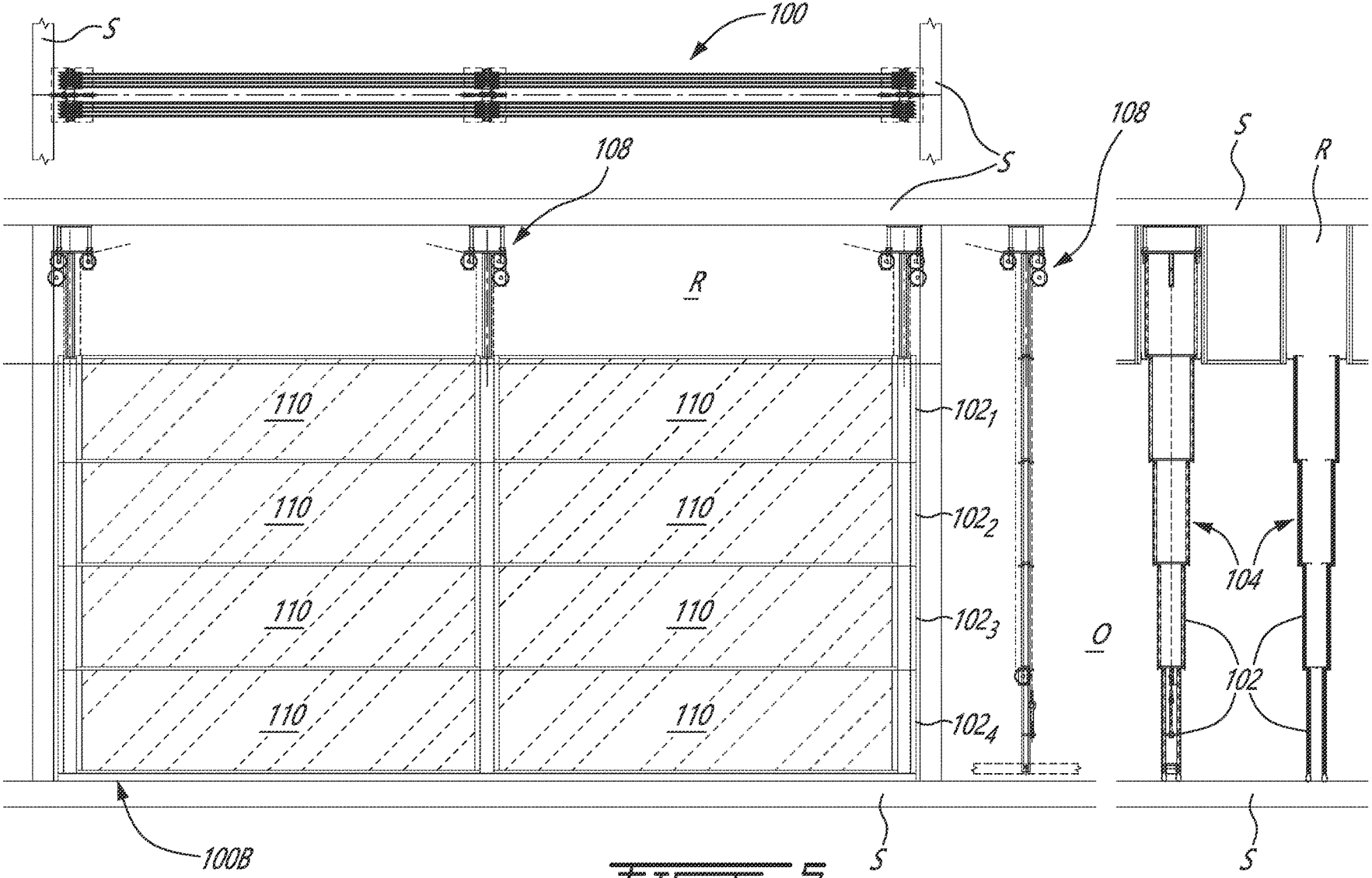

FIGS. 4A to 4C show examples of possible intermediate positions of the telescoping wall 100, in its transition between the retracted position 100A (FIGS. 2A-2B) and its extended position 100B (FIGS. 1A-1B).

As shown in FIGS. 3-7, the telescoping wall 100 in this embodiment is vertical and attached to a structure (S) to selectively cover or expose an opening (O) in the structure (S). As a non-limiting example, the structure (S) in this embodiment is a wall that may be a part of a building for example, and the opening (O) may be for example an entrance into the building or a passage between adjacent spaces in the building. The relevant portion of the structure (S), and in this embodiment the portion above the opening (O), may be built or retrofitted (if pre-existing) to define a downwardly-open recess (R) therein above the opening (O). In this example, the recess (R) spans at least the portion of the opening (O) to be selectively covered by the telescoping wall 100, although any suitable size of the recess (R) may be used to suit each particular embodiment and size of the telescoping wall 100. In some embodiments, the recess (R) may be omitted.

Figure 5:
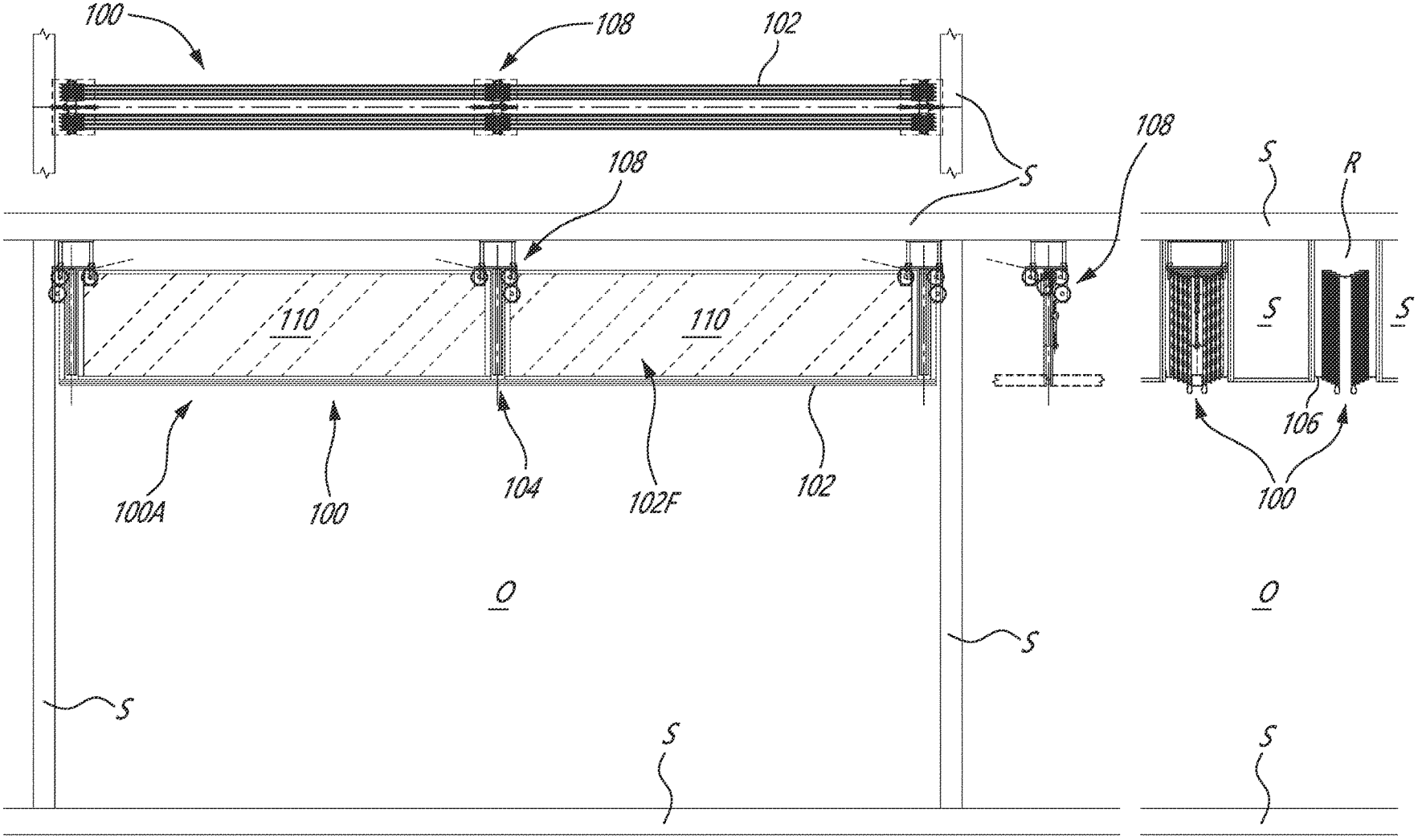
FIG. 5 shows schematic multiple views of the telescoping wall of FIG. 1, the telescoping wall being in the extended position, as per FIGS. 1A-1B.

As shown in FIGS. 3 through 6, the telescoping wall 100 includes four frame sections 102, labeled 1021, 1022, 1023, 1024 in FIGS. 5 and 6 where all are clearly visible, that are slidingly received one into the other (as shown, each frame section 102 is narrower than a preceding frame section 102 into which it slides in when retracted) to form a telescoping frame 104 of the telescoping wall 100. Any other number of frame sections 102 may be used depending on each particular embodiment and application of the telescoping wall 100.

As shown, in this embodiment, a top one of the frame sections 1021 is slidingly removably received in the recess (R), with a subsequent one of the frame sections 102 being slidingly removably received in the top one of the frame sections 1021, and so on until the last one of the frame sections 102. In some embodiments, at least a part of the top frame section 102 may protrude downward out of the recess (R) when retracted. In the present embodiment, the recess (R) and each of the frame sections 102 except for the frame section 102 at the bottom of the telescoping wall 100, includes a stopper 106 attached to a bottom end thereof. In this embodiment, each of the stoppers 106 is a pair of opposed metal brackets extending inward from each respective bottom end, but any other suitable construction may likewise be used so long as the functionality described in this document is provided.

As shown in FIG. 4B for example, when the top one of the frame sections 1021 extends downward out of the recess (R), the stopper 106 of the recess (R) engages a top portion of the top one of the frame sections 1021 to define an extended position 102E of the top one of the frame sections 1021. In its extended position 102E, the top one of the frame sections 1021 hangs from and is supported by the stopper 106 of the recess (R). Similarly, each subsequent one of the frame sections 102 that slidingly fits into a preceding one of the frame sections 102 engages the stopper 106 of the preceding one of the frame sections 102 when extended and hangs from and is supported by the stopper 106 of the preceding one of the frame sections 102.

Referring still to FIGS. 3 to 6, the frame sections 102 are connected, for example via steel or other suitable cable(s) (not labeled), to a sheave system 108, which may be any sheave system suitable for each particular embodiment and size of the telescoping wall 100. In some embodiments, the sheave system 108 may be manually operable for example by a lever. In some embodiments, the sheave system 108 may be automatically operable, and would thus include one or more suitable motor(s), transmission(s), switch(es) and controller(s). In some embodiments, the sheave system 108 may be both automatically or manually operable. The sheave system 108 in this non-limiting embodiment is disposed inside the recess (R) so as to be hidden from view in all positions of the telescoping wall 100. The sheave system 108 is selected to be operable to retain the telescoping wall 100 in the retracted position 100A (FIGS. 2A-2B, 3) in which the telescoping wall 100 exposes the opening (O) in the structure (S), and to lower the telescoping wall 100 into the extended position 100B (FIG. 5) in which the telescoping wall 100 covers at least a majority of the opening (O). In some embodiments, the sheave system 108 may be configured to also position the telescoping wall 100 in one or more interim positions, such as those shown in FIGS. 4A to 4C for example.

As best shown in the elevation view of FIGS. 5 and 6 in which the telescoping wall 100 is in its extended position 100B, in this embodiment each of the frame sections 102 defines through its opposed faces 102F (i.e. through the major faces which act to selectively close the opening (O)), two adjacent apertures 102A (FIG. 6). As shown, the apertures 102A occupy a majority of an area of the corresponding opposed faces 102F in which the apertures 102A are defined. In some such embodiments, one or more of the apertures 102A occupy more than 50% and up to 99% of the area of each of the respective opposed faces 102F through which the one or more of the apertures 102A is/are defined. In some embodiments, one or more of the apertures 102A occupy between 60% and 99% of the respective face area. In some embodiments, one or more of the apertures 102A occupy between 70% and 99% of the respective face area. In some embodiments, one or more of the apertures 102A occupy between 80% and 99% of the respective face area. In some embodiments, one or more of the apertures 102A occupy between 90% and 99% of the respective face area. In some embodiments, one or more of the apertures 102A occupy between 90% and 95% of the respective face area.

In some embodiments, one or more of the frame sections 102 may define a different number of apertures 102A therethrough, the number being for example a single aperture 102A or more than two apertures 102A. The apertures 102A may each have any size and shape suitable for each intended application of the telescoping wall 100. As shown in FIG. 5, when the telescoping wall 100 is assembled, each of the apertures 102A is covered with a panel 110 that is removably attached to the one of the frame sections 102 defining that aperture 102A.

Figure 7:
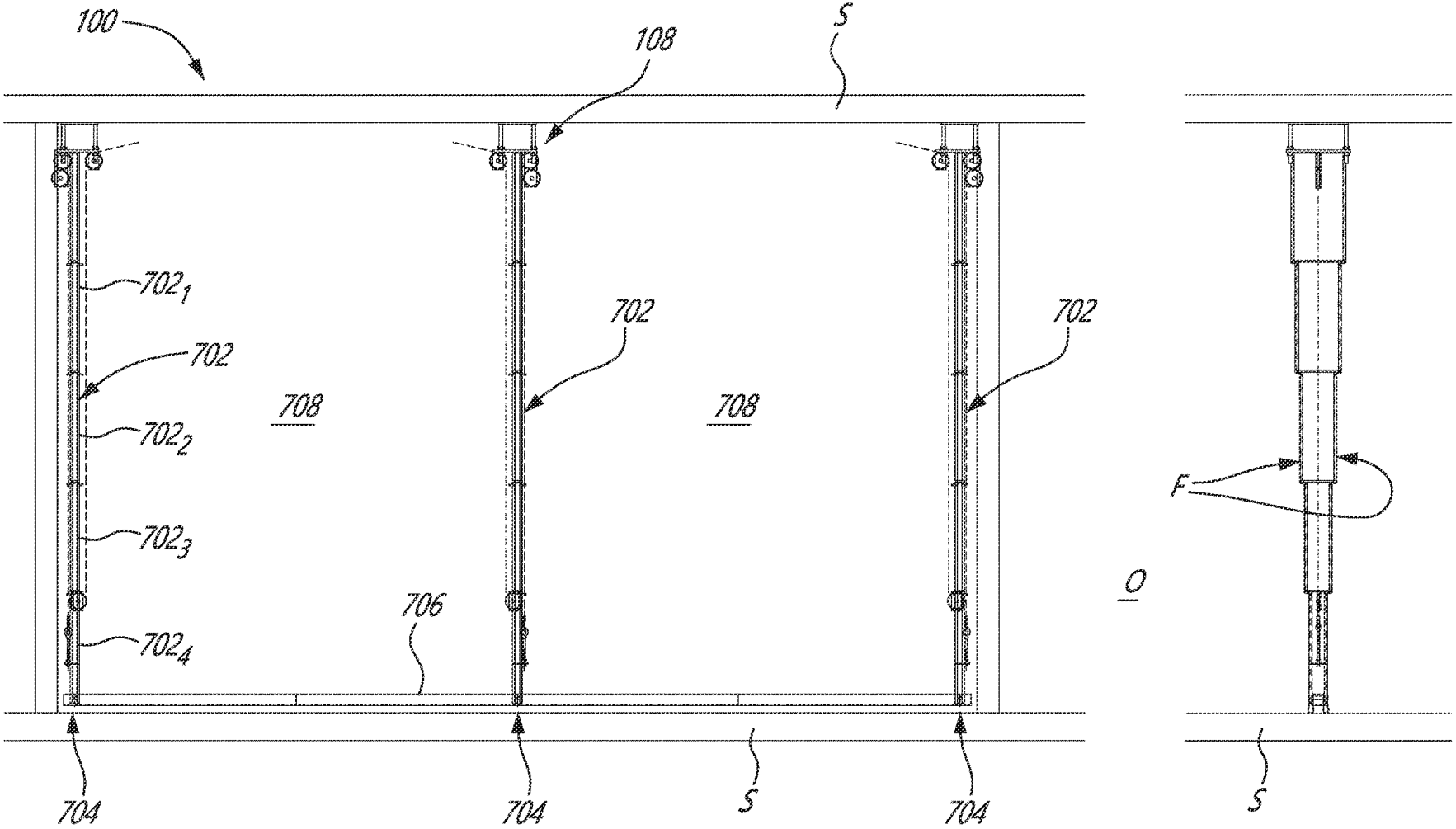
FIG. 7 shows multiple views of another embodiment of the frame sections of the telescoping wall, with panels of the telescoping wall removed therefrom.

In yet other embodiments, such as an alternative embodiment of the frame sections 702 shown in FIG. 7, each of the frame sections 702 may be independent from the other frame sections 702 and may thus form an independent telescoping vertical assembly 704. As shown in FIG. 7, the frame sections 702 may form three independent telescoping assemblies 704, which may be interconnected by the panels 110 when the panels are removably engaged/removably attached thereto, such as for example in a similar way as described in this document with respect to the frame assemblies 102. For clarity, only one of the frame sections 702 is labeled in each independent telescoping assembly 704. In this embodiment, each adjacent pair of the independent telescoping assemblies 704 may define an aperture 708 through the face (F) of the telescoping wall 100. Multiple ones of the panels 110 may cover each of the apertures 708 at one or both of the telescoping wall's 100 faces (F).

As shown in FIG. 7, the apertures 708 may thus span at least a majority, and in this embodiment a substantial part, of the height of the opening (O) when the telescoping wall 100 is in its extended position 100B. As shown in FIG. 7 in dashed lines, the telescoping assemblies 704 may be interconnected with one or more cross-members 706, and thus may not be independent from each other in some embodiments. In some embodiments, the telescoping wall 100, 100' may have a combination of one or more frame sections 102 and one or more frame sections 702. The panels 110 may be removably attached to the respective frame sections 702 in the same way as described with respect to the frame sections 102.

Thus, referring to FIGS. 8A to 10, irrespective of the particular embodiment and combination of the frame sections 102, 702, the panels 110 may be hinged, via respective hinges 112, to respective ones of the frame sections 102, 702. Hence, each given panel 110 may be manually movable between a closed position 110A and an open position 110B (as shown in FIGS. 8B and 8C, for example) at least when the respective frame section 102, 702 to which it is removably hinged is extended relative to a preceding one of the frame sections 102, 702, or relative to the structure (S) in case of the top frame section 1021/7021 that is adjacent the structure (S).

Figure 8:
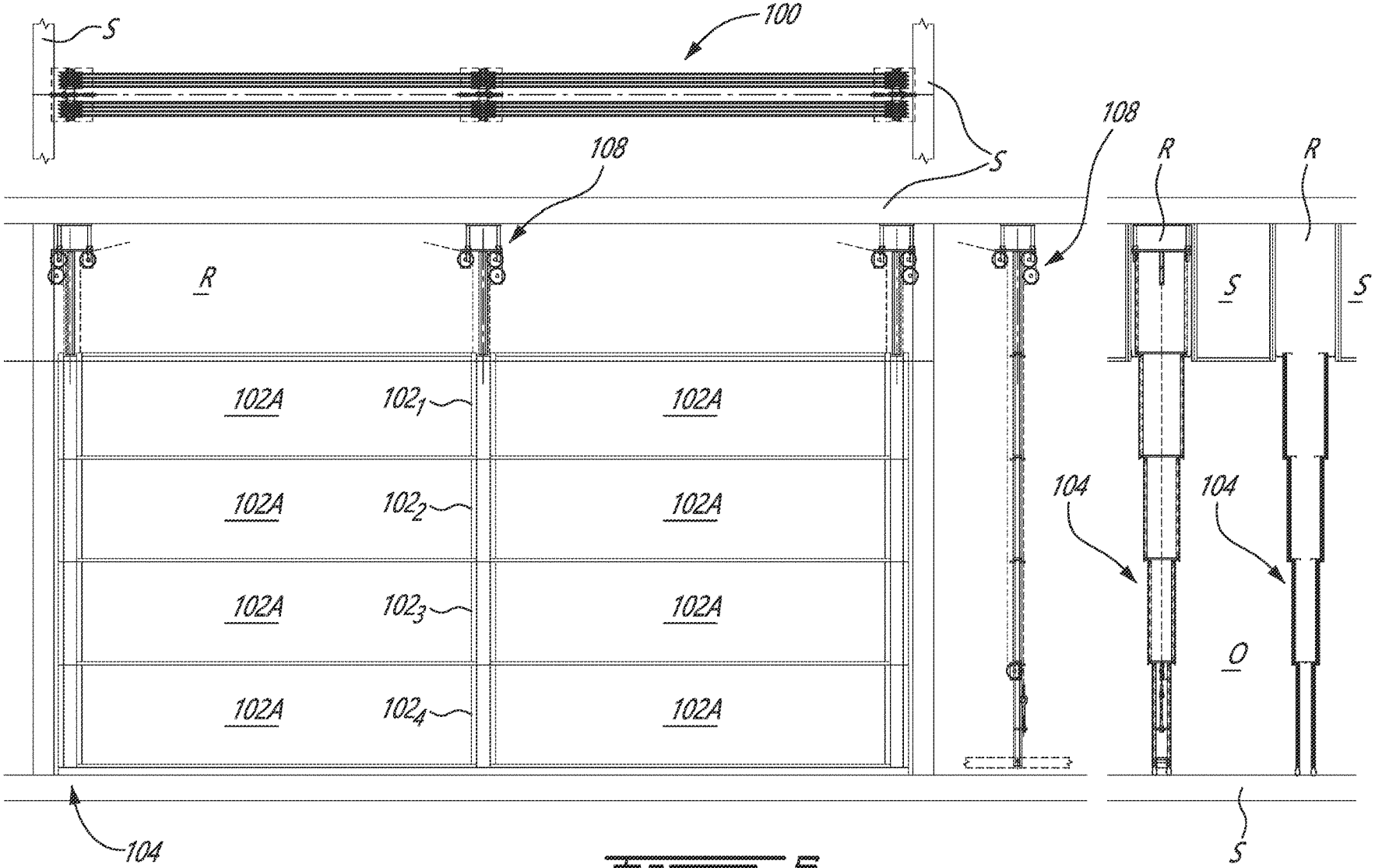
FIG. 8A shows a schematic side elevation view of the telescoping wall, the telescoping wall being in the extended position with the panels shown in respective closed positions in solid lines, and with the panels shown in respective open positions in dashed lines.
FIG. 8B shows a partial perspective view of the telescoping wall, in its extended position, with one of the panels shown in an open position.
FIG. 8C is a more detailed perspective view of the open panel of the telescoping wall, shown in its extended position.
Figure 8A:
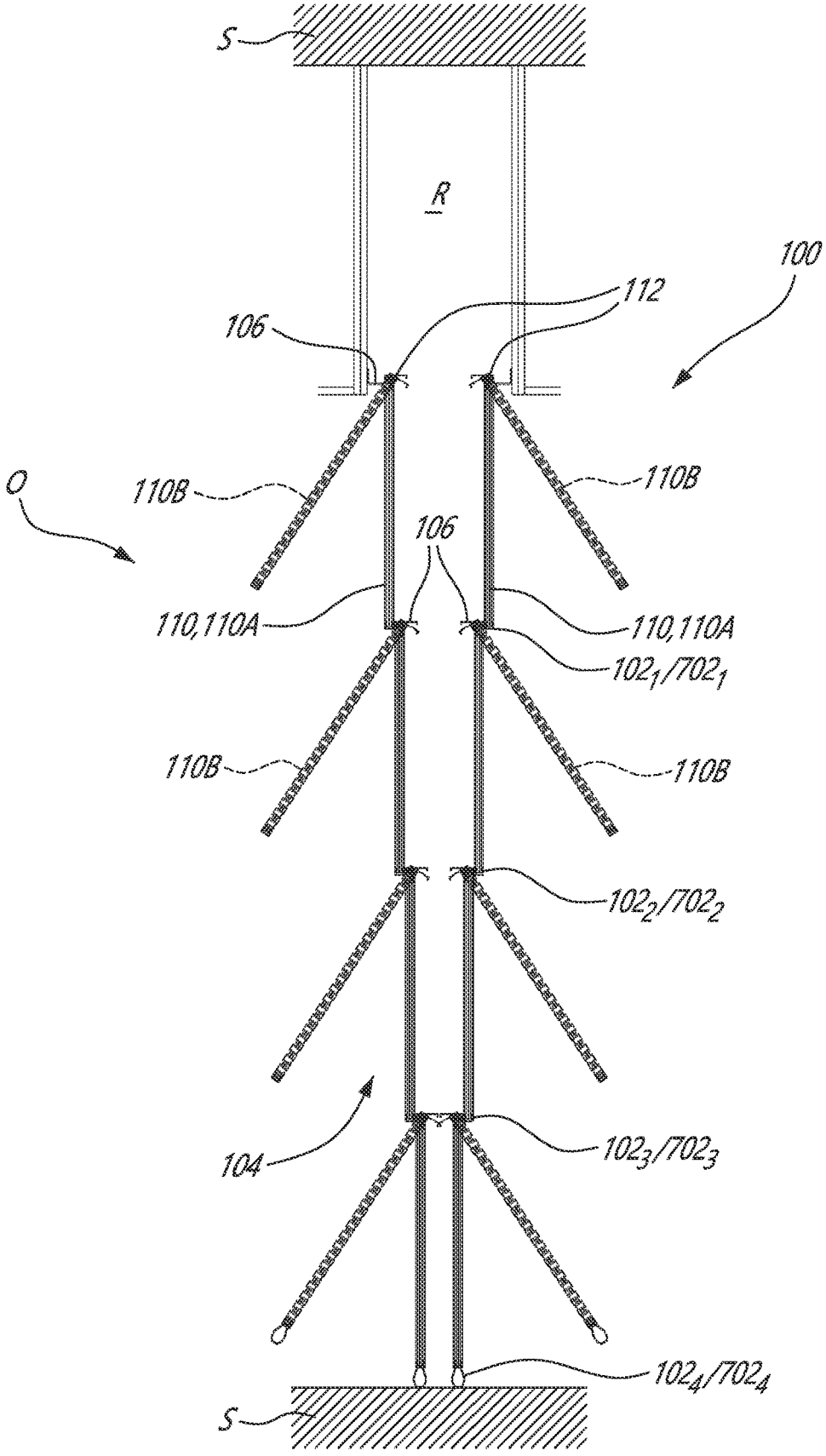
Figure 8B:
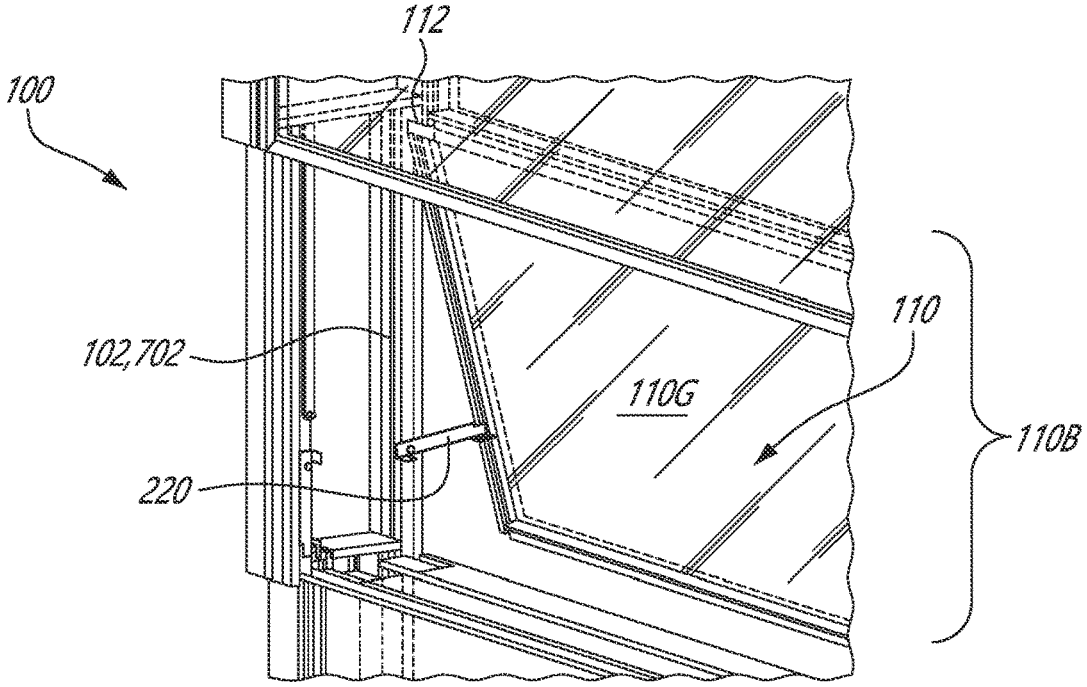
Figure 8C:
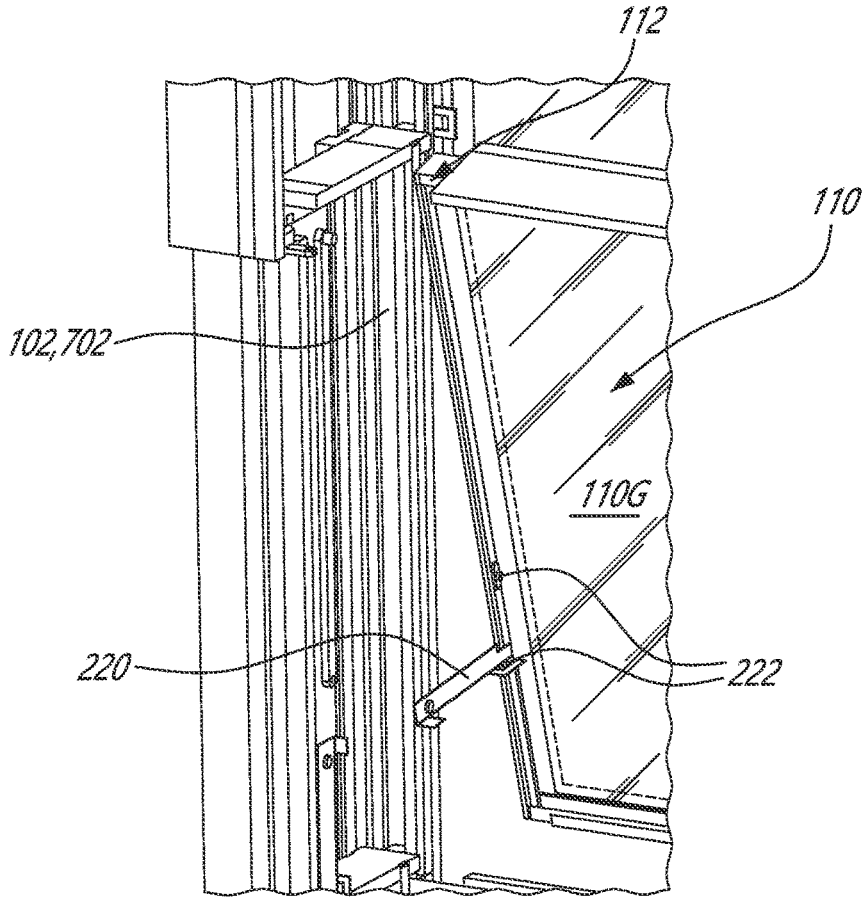

Referring more specifically to FIGS. 8B and 8C, one of the panels 110 of the telescoping wall 100, when the wall is disposed in its extended position 100B as shown in FIG. 8A, can be manually opened by pivoting the panel 110 about its upper hinge 112. Accordingly, the panel 110 can be pivoted into an open position 110B thereof, as shown. In one particular embodiment, a retention element or latch 220 may be used to retain the panel 110 in a fully open position 110B and/or to act as a travel-limited to restrict the angular degree to which the panel 110 can be pivoted about hinge 112. In other words, the retention element 220 can provide a maximum extended position for the pivoting panel 110 when it is opened and/or the retention element 220 can retain the panel 110 in an open position 110B (either the fully open position or a select intermediate position thereof) such that it does not close unwantedly. In the embodiment where the retention element 220 is manually positioned by the user, for example, the retention element 220 may be pivotably attached to the frame section 102, 702 at one end (e.g. an inner end) thereof, and may be releasably engaged to a pin or other engagement fixture 222 on pre-determined points on the frame of the panel 110. Accordingly, the user may position the opened panel 110 at one of several possible angular open positions, as may be required for cleaning or for other purposes.

It is to be understood that in FIGS. 8B and 8C, one of the panels on the side closest to the viewer has been removed from these drawings for the purposes of explanation only, so as to be better able to see the pivoted open panel 110 and the retention element 220 as described above.

It is also contemplated that in some embodiments, one or more actuators, such as conventional actuators for example, may be included within the telescoping wall 100 to automatically move one or more of the panel 110 between the respective closed position(s) 110A and open position(s) 110B. Accordingly, in one possible embodiment, the retention elements 220 as described above may be actuators which can be remote actuated and can permit positioning an open panel at any number of possible angular positions relative to the closed position thereof.

Figure 9:
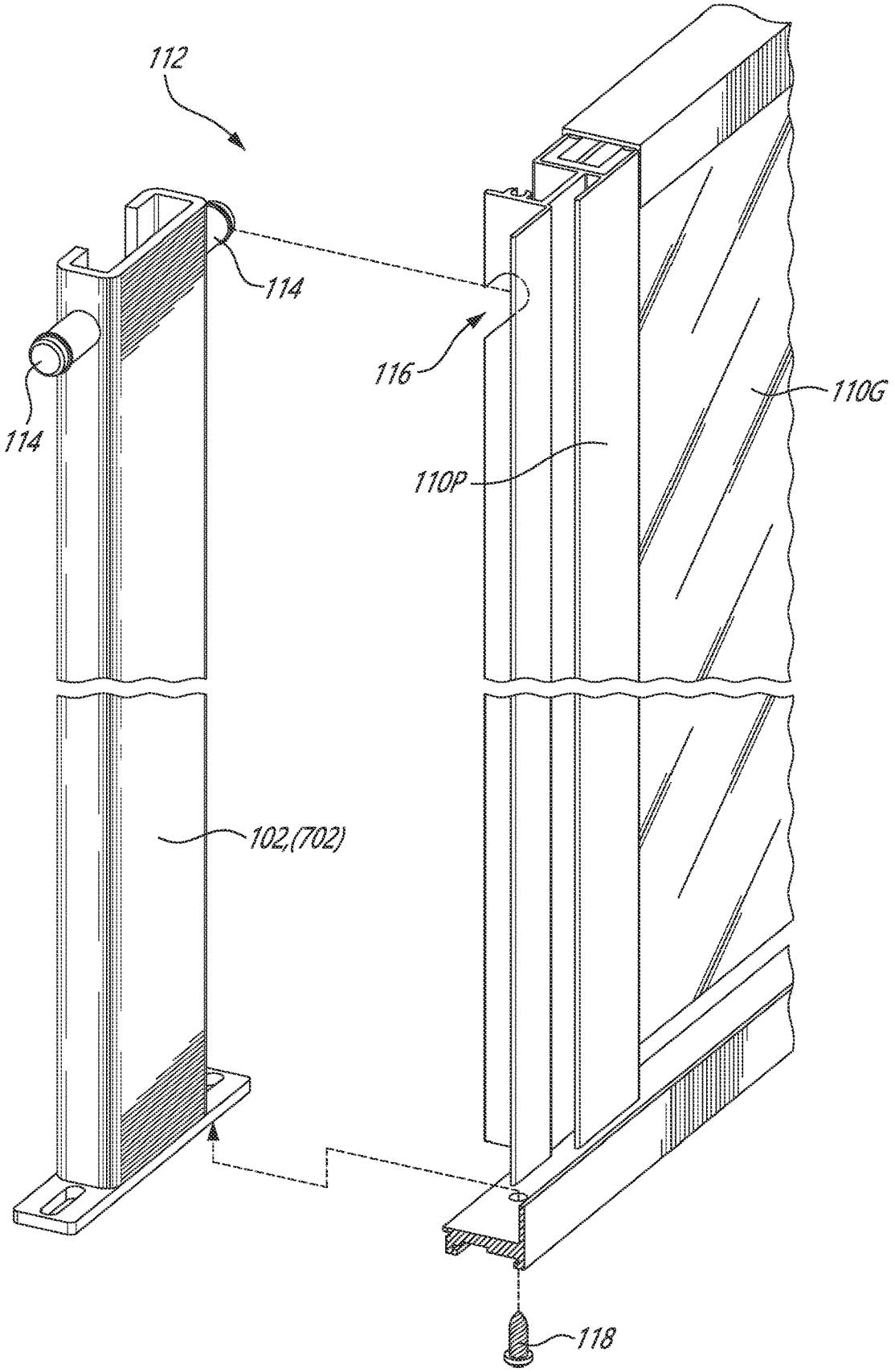
FIG. 9 is a schematic perspective view of an upper left edge and a bottom left edge of one of the panels, and respective portions of a respective frame section of the telescoping wall.

As best shown in FIG. 9, in the embodiment of frame sections 102 (and hence the same may be the case for frame sections 702), each frame section 102 has two panels 110 hinged thereto on each of its two opposed faces 102F, and each of the two panels 110 is hinged to that frame section 102 at its opposed top edges via respective left-handed and right-handed hinges 112. One of the hinges 112, and more particularly a center double-sided hinge 112, is shown in detail in FIG. 9. The hinge 112 includes two opposed male hinge members 114 attached to a respective portion of the respective one of the frame sections 102. In this non-limiting embodiment, the hinge members 114 are defined by a metal pin inserted through a corresponding aperture in the frame section 102, although other suitable constructions may be used. The hinge 112 further includes a female hinge member 116 defined in a respective portion of the respective one of the panels 110.

Figure 10:
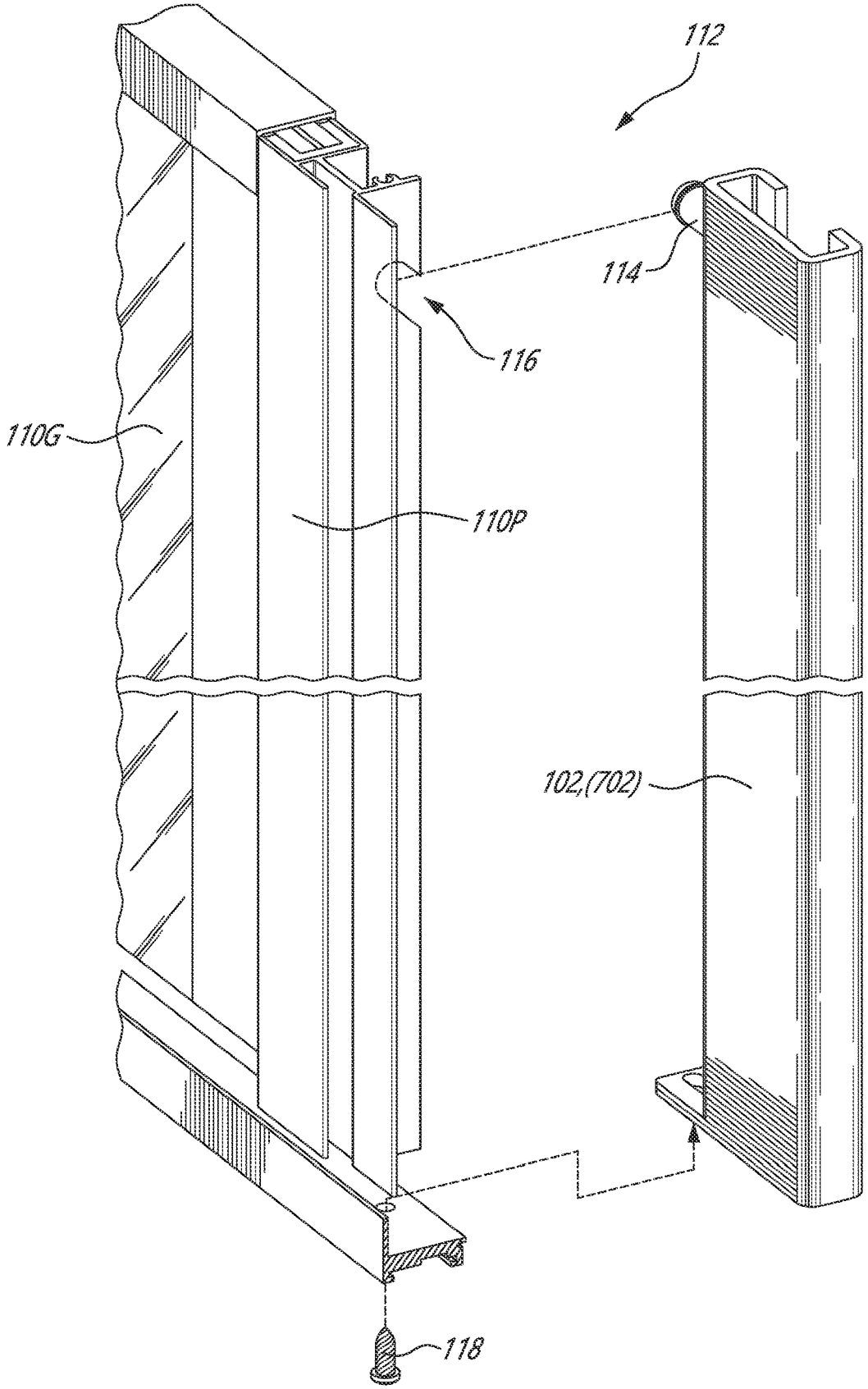
FIG. 10 is a schematic perspective view of an upper right edge and a bottom right edge of the one of the panels of FIG. 9, and respective portions of the respective frame section of the telescoping wall.

The female hinge member 116 is sized and shaped to removably receive a respective one of the male hinge members 114 therein, for removably and pivotably attaching the panel 110 to the frame section 102. In this non-limiting embodiment, the female hinge member 116 is defined by a slot open toward the respective male hinge member 114 and angled at 45 degrees relative to the panel 110. While the present construction may provide some advantages in some applications, such as for example relative ease of installation and/or removal, other suitable constructions and/or angles of the female hinge member 116 may be used, for example to suit each particular embodiment of the respective male hinge member 114, so long as the functionality described herein is provided. In this embodiment, a similar hinge 112 is defined at the other top edge of the panel 110. As shown in FIG. 10, the other hinge 112 may be a mirror image of the hinge 112 of FIG. 9. As shown in FIG. 10, the part of the frame section 102 corresponding to the other hinge 112 may not have a second male hinge member 114 due to being at a lateral side of the telescoping wall 100 as opposed to being in the center thereof.

Accordingly, in this non-limiting embodiment, to be installed, the panel 110 may be manually positioned at, for example, 45 degrees to the respective frame section 102 as shown in FIG. 8A, so as to align the corresponding male and female hinge members 114, 116 with each other. The panel 110 may then be hung into place by moving it so as to insert the male hinge members 114 into the female hinge members 116. The panel 110 may then be pivoted to its closed position 110A. In this embodiment, and although this need not be the case with other embodiments, the panel 110 is secured in its closed position 110A. As shown in FIG. 9, in the present embodiment the securement may be done with one or more screws 118 received through a bottom edge of the panel 110 (in this case, a frame portion of the panel 110) and into the respective frame section 102, and tightened.

The screw 118 is an example of a fastener. Any other fastener and/or other securement may be used. In some embodiments, one or more of the panels 110 may not be secured in their respective closed position(s) 110A and may simply remain therein due to gravity. The other panels 110 may have a similar construction and therefore the other hinges are not shown in detail. To remove the panel 110, the one or more screws 118 may be removed, the panel 110 may then be pivoted back to an open position 110B, such as the 45 degree position described above, and may then be taken off the respective male hinge members 114. Understandably, where no securement of the panel 110 is provided in its closed position 110A, the step of removing/disengaging the securement may be skipped.

As shown with dashed lines in FIG. 5 and with reflection lines in FIGS. 7 and 8, the panels 110 in this embodiment are transparent. More particularly, in this embodiment a majority of each of the panels 110 may be made from a glass section 110G or any suitable plastic-based glass such as Plexiglas™, with the remainder of each of the panels 110 being a panel frame 110P which in this non-limiting embodiment is made of metal components. Since a majority of these panels 110 is transparent, the panels 110 are simply referred to as being transparent. In some embodiments, one or more of the panels 110 may be made at least substantially entirely, in some embodiments including at least parts of the structural portions (hinges 112, etc.) of the panels 110, of one or more suitable polymers, such as conventional transparent and/or translucent polymers (collectively, polymeric materials).

While transparent and/or translucent panels 110 may provide some advantages such as providing for passage of ambient light through the opening (O), in other embodiments, the panels 110 may be opaque for example, and/or may have any other construction that may be desired for a particular application of the telescoping wall 100. In embodiments in which one or more entirely or substantially entirely polymeric panels 110 are used, weight of the telescoping wall 100 may be reduced. In some such embodiments and/or applications, certain components may be reduced in size as may be allowed by reduced overall weight of the telescoping wall 100.

Irrespective of the particular construction of the panels 110, moving one or more of the panels 110 into the respective open position(s) 110B while the telescoping wall 100 is in use and in its extended position may provide access into the telescoping wall 100. In transparent panel 110 embodiments, such access may allow to clean the panel(s) 110 from the inside without having to remove the panel(s) 110 from the telescoping frame 104, or at least without having to disassemble the telescoping frame 104 if the panel(s) 110 are removed therefrom for the cleaning. For non-transparent panel(s) 110, such access may allow servicing the telescoping wall 100 from the inside without removing at least some of, and in some embodiments any of, the panels 110 from the telescoping frame 104. In some embodiments, such access may allow servicing the telescoping wall 100 from the inside by removing one or more of the panels 110 from the telescoping frame 104, but without having to disassemble the frame sections 102.

Figure 11A:
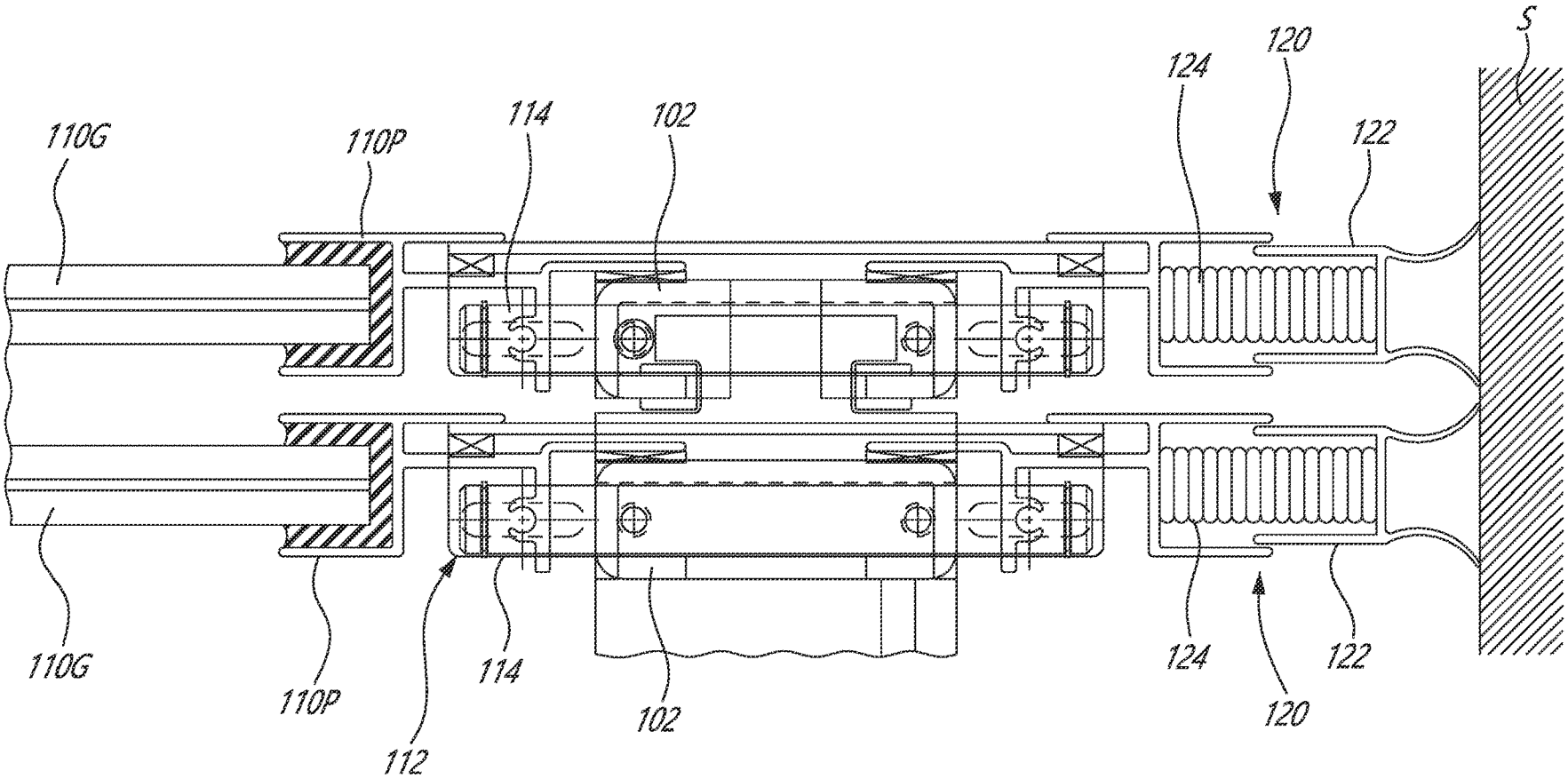
FIG. 11A is a schematic top section view of lateral sides of two of the panels and frame sections of the telescoping wall.
Figure 11B:
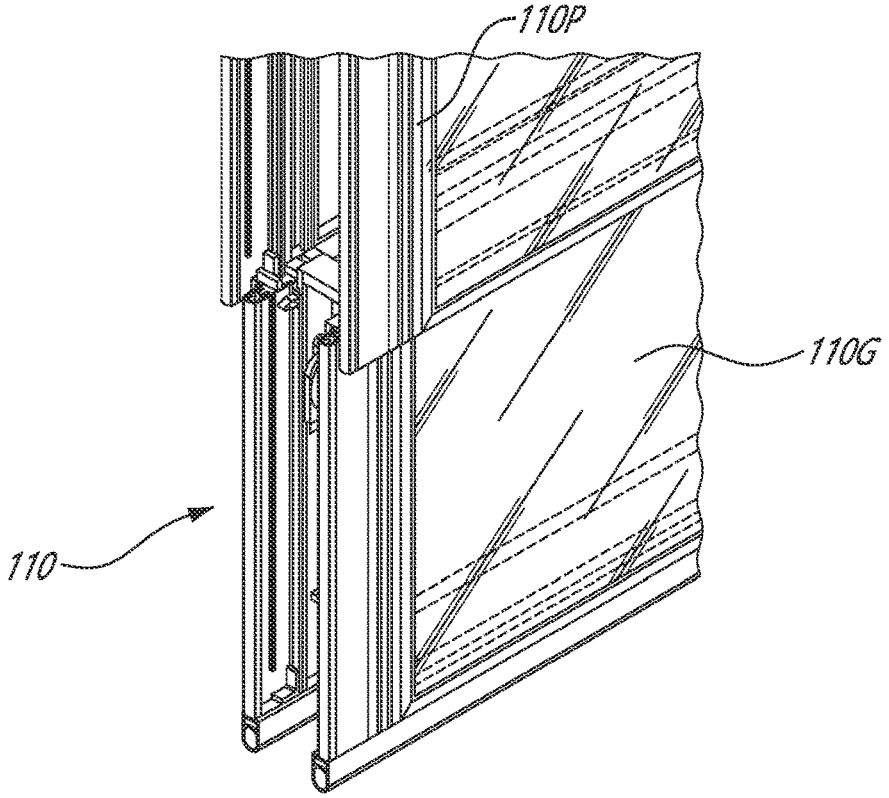
FIG. 11B is a schematic perspective view of the lateral sides of two of the panels and fame sections of the telescoping wall.
Figure 11C:
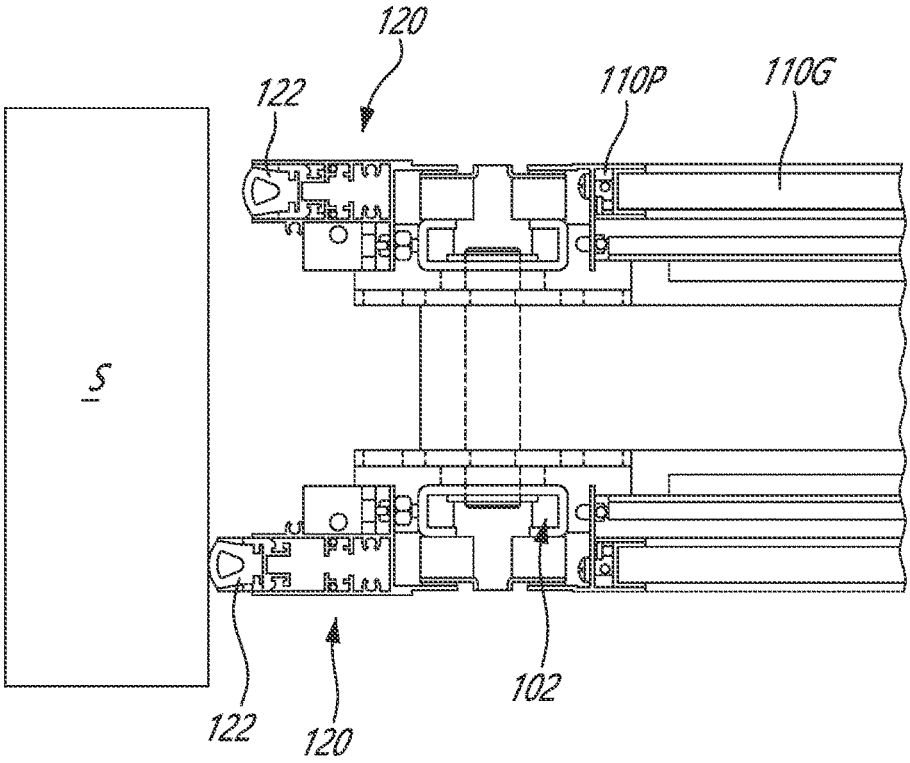
FIG. 11C is another schematic top section view of lateral sides of two of the panels and frame sections of the telescoping wall, showing the lateral seals in both an extended position and a retracted position.

Now referring to FIGS. 11A-11C, embodiments of a lateral side of two of the frame sections 102 of the telescoping wall 100 are shown. In at least one embodiment, each of the frame sections 102 has a lateral seal 120 that slidably engages the part of the structure (S) that defines a corresponding lateral side of the opening (O). Each of the lateral seals 120 includes a movable member 122. In one embodiment, the movable members 122 are biased toward and slides against the part of the structure (S) that defines a corresponding lateral side of the opening (O), when the telescoping wall 100 is extended or retracted. In one embodiment, the movable member 122 is biased using a suitable biasing mechanism, such as a spring 124. In the embodiment of FIG. 11A, the movable member 122 includes two contacting portions that are arcuate and extend away from each other, which helps improve the sealing action. In other embodiments however, a different shape of one or more of the movable members 122 may be used. For example, in the embodiment of FIG. 11C, each of the end seals of the movable members 122 may include bulb type or other end seals. FIG. 11C also depicts one of the two movable members 122 of the lateral seal 120 (namely the upper one in FIG. 11C) shown in a retracted position, whereas the other moveable member 122 of the lateral seal 120 (namely, the lower one in the FIG. 11C) is shown in an extended position whereby it is in contact with the lateral surface of the structure (S). It is to be understood that these two seals are shown in different positions for the purposes of explanation. Typically, however, the two lateral seals 120 will operate together, i.e. either both retracted when the telescoping wall 100 is being extended or retracted or both extended, once the telescoping wall 100 is in its extended position, to form the lateral seal with the structure (S).

The telescoping wall 100 and its various parts, as well as the structure (S) and opening (O) may be made using conventional materials and manufacturing and assembly methods suitable for each particular embodiment and application of the telescoping wall 100, so long as the functionality described herein is provided. As can be seen therefore, the embodiments and examples described herein and illustrated are intended to be non-limiting. A person of ordinary skill in the art will understand that many modifications thereto may be made without departing from the scope of the present disclosure.

For example, while each of the panels 110 in the above embodiment has two hinges, one at (i.e. proximate) each top lateral edge of each of the panels 110, a different number of hinges may be used, such as for example a single central hinge on one or more of the panels, or more than two hinges. As another example, the hinge(s) of one or more of the panels 110 may be of a sliding type instead of a pivoting type. As another example, while the hinge(s) 112 may provide advantages in some embodiments and applications, the hinge(s) 112 of one or more of the panels 110 may instead be a different mechanism selected to provide for the functionality of the one or more of the panels 110 as described herein. As another example, the hinge(s) 112 of one or more of the panels 110 may be omitted and instead one or more fasteners, such as screw(s), bolt(s), clip-in member(s) receivable in corresponding aperture(s) in the corresponding frame section(s) 102, and the like may be used to secure the one or more of the panels 110 in the closed position 110A and may be disengageable and/or removable to allow the one or more of the panels 110 to be displaced into an open position which may simply mean the panel(s) 110 is/are taken off the corresponding frame section(s) 102.

Figure 12:
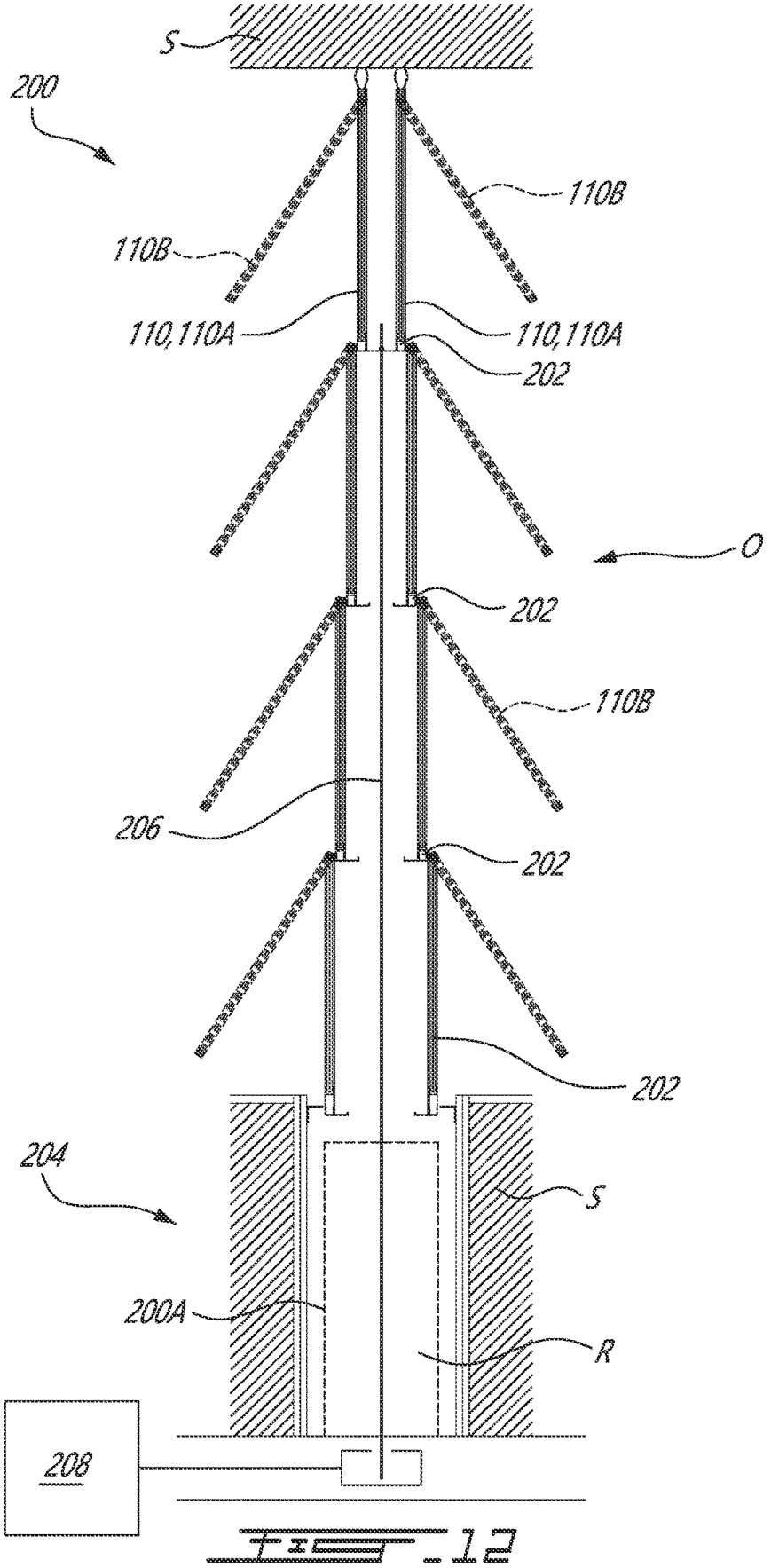
FIG. 12 shows a schematic side elevation view of a telescoping wall of the present disclosure.

As another example, and now referring to FIG. 12, while in the embodiment of FIGS. 3 to 9, the telescoping wall 100 is a "hanging wall" that extends downward toward a floor for example, in other embodiments such as the embodiment of the telescoping wall 200 shown in FIG. 12, may be disposed instead in a floor, road, or other structure (S) and may be operable to extend (i.e. telescope) upward (i.e. against gravity) from its retracted position 200A. To this end, the frame sections 202 of the telescoping wall 200 may be connected to a suitable jack system 204, such as any conventional suitable jack system, instead of a sheave system 108 for example.

As an example, the jack system 204 may include a telescoping actuation assembly 206 operatively connected to an actuator 208, such as an electric motor and/or hydraulic motor and/or hydraulic pumps, etc., depending on each particular embodiment and application of the telescoping wall 200. The actuator 208 may thus be configured to drive the jack system 204 to move the telescoping wall 200 between its retracted position 200A and its extended position 200B. In some such embodiments, the telescoping wall 200 may have an outdoor application, in which case it may not necessarily be used to selectively cover an opening, but may instead be used for example as a retractable roadblock. In some such applications, the panels 110 may be armored.

Figure 13:
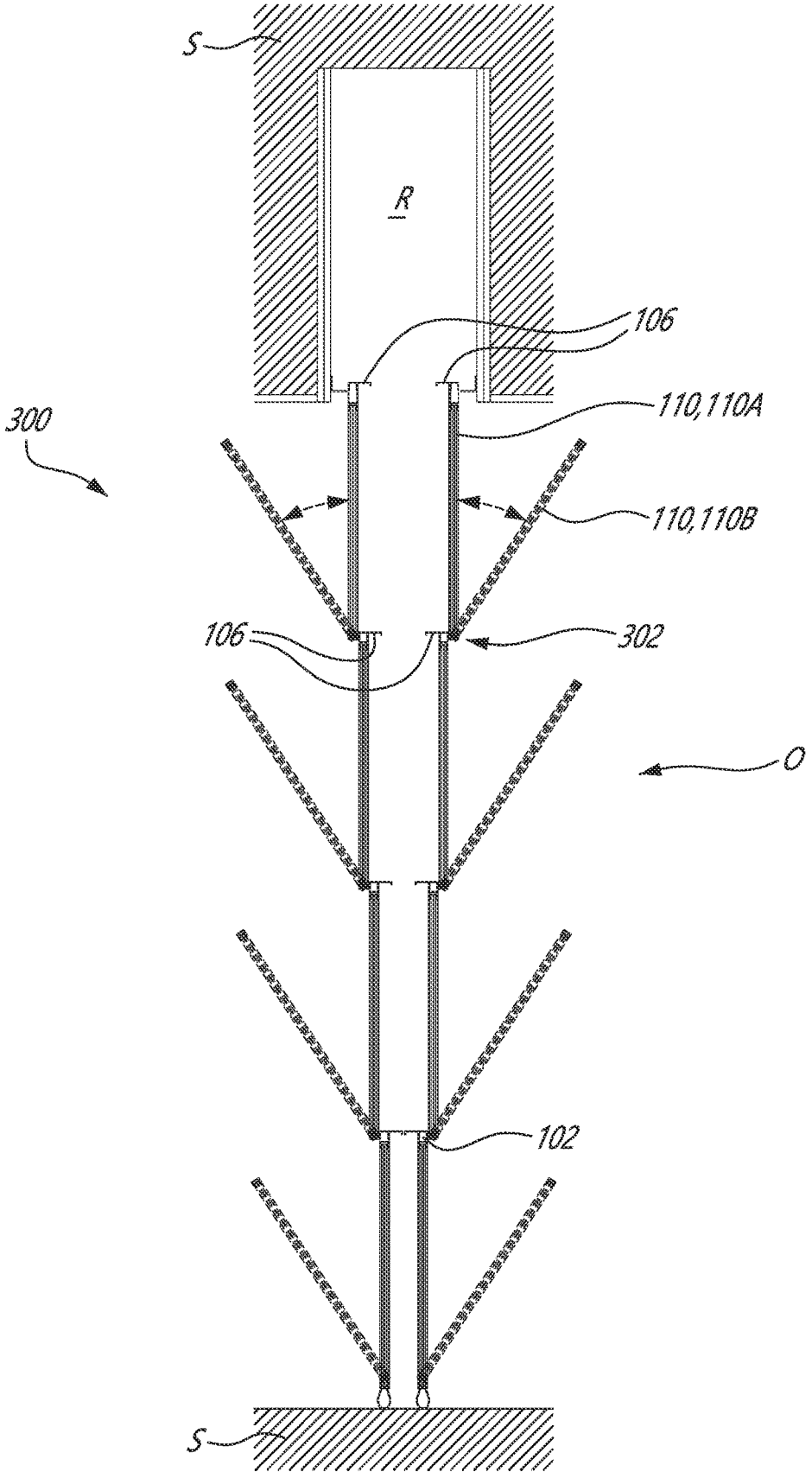
FIG. 13 shows a schematic side elevation view of a telescoping wall of the present disclosure.

As yet another example, depending on the particular application of the telescoping wall 100, 200, the panels 110 may be hinged at their bottom edges and/or wall/portion instead of at the top, as shown in FIG. 13. The telescoping wall 300 shown in FIG. 13, may be similar to the telescoping wall except insofar as the placement of the hinges 112 at the bottom of the panels 110 (shown with reference numeral 302), and is therefore labeled with similar reference numerals and is not again described herein in detail.

Figure 14:
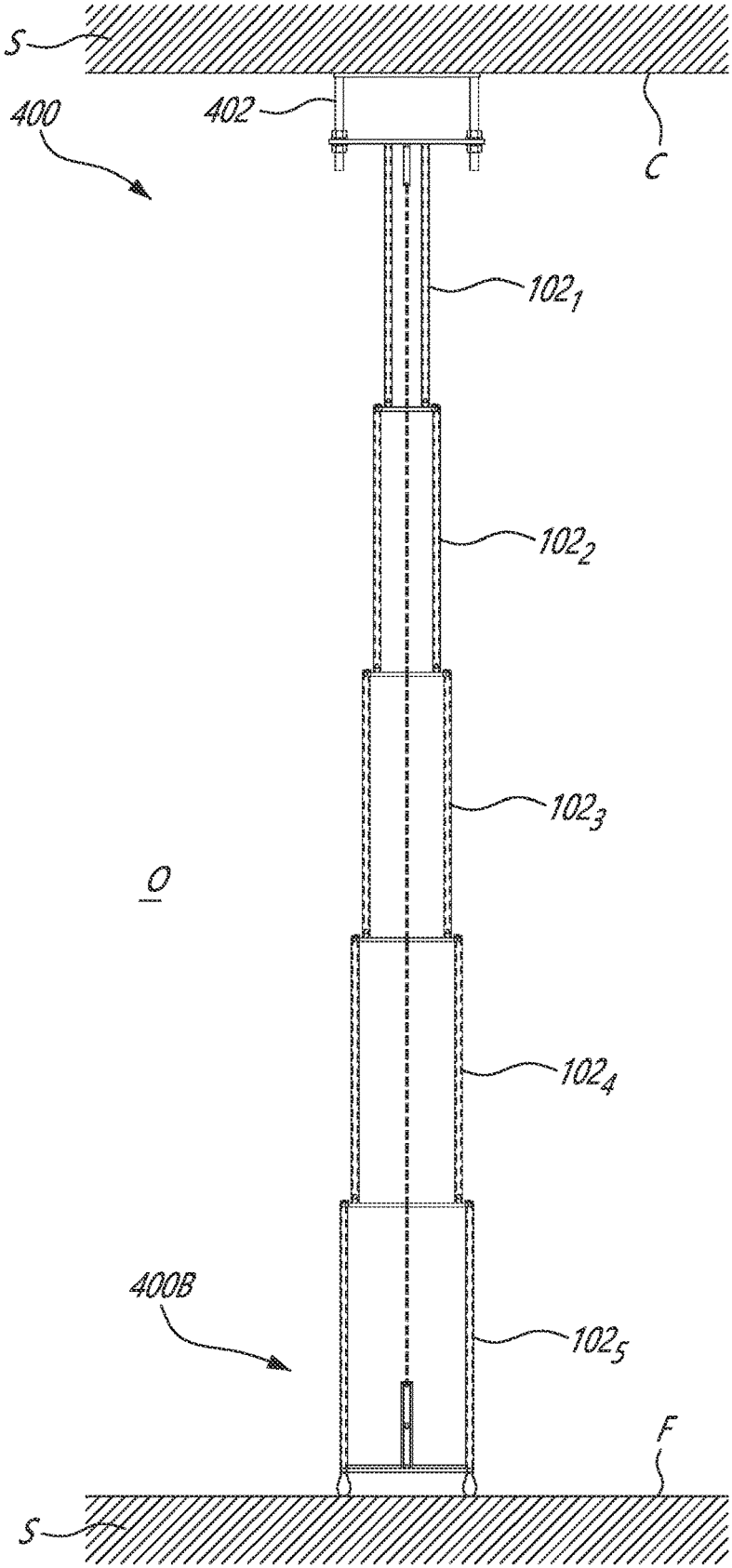
FIG. 14 shows a schematic side elevation view of a telescoping wall of the present disclosure.

As yet another example, and as shown in FIG. 14, in yet other embodiments, the telescoping wall 400 may be attached directly to a ceiling (C) or other non-concealed part of a structure (S), such as via any suitable connecting assembly 402 or directly via the top frame section 1021 for example. In some embodiments thus, the telescoping wall 100-400 need not be retractable into a recess. Further as shown in FIG. 14, in some overhead-attachment embodiments, the telescoping wall 400 may be structured such that its frame sections (102 and/or 702, etc.) sequentially increase in width from the top frame section to the bottom frame section instead of decreasing in width as in the telescoping wall 100 described above, for example. As shown in FIG. 14, in its extended position, the thickest frame section (i.e. the bottom frame section) may be proximate to and/or contact a floor (F) of the structure (S) when the telescoping wall 400 is in its extended position 400B.

As yet another example, in some embodiments, the panels 110 of the telescoping wall 100, 200 may be omitted from one face of the telescoping wall 100, 200. As yet another example, in some embodiments, one or more of the frame sections 102, 202 etc., of a given telescoping wall 100, 200 need not have an aperture 102A and/or panel(s) 110. As yet another example, a given embodiment of the telescoping wall may have a combination of features of one or more of the telescoping wall embodiments described in this document. Yet further modifications are possible without departing from the scope of the present technology.

What is claimed is:

1. A collapsible wall, comprising:

a plurality of frame sections engaged with each other to form a telescoping frame movable vertically between an extended position and a retracted position, in the extended position the plurality of frame sections defining a first vertical wall height and in the retracted position the plurality of frame sections are slidingly received one into the other to define a second vertical wall height less than the first vertical wall height, the frame sections forming at least a portion of a face of the collapsible wall and defining an aperture through the face; and a panel removably engaged to the frame sections via a hinge, the panel covering the aperture when the panel is disposed in a closed position, wherein the panel is pivotable between the closed position and an open position when the frame sections are in an extended position, the panel in the open position providing access into at least one of the frame sections via the aperture.

2. The collapsible wall of claim 1, wherein at least a part of the panel is transparent or translucent, and the aperture occupies a majority of an area of the face.

3. The collapsible wall of claim 1, wherein the face is two opposed faces of the collapsible wall, and the panel is two panels, one of the two panels covering the aperture at one of the two opposed faces and the other of the two panels covering the aperture at other of the two opposed faces.

4. The collapsible wall of claim 1, wherein the panel includes a panel frame removably engaged to the frame sections and a transparent or translucent portion engaged to the panel frame.

5. The collapsible wall of claim 1, wherein the panel is made substantially entirely of a transparent or translucent material.

6. The collapsible wall of claim 1, wherein the hinge is a plurality of hinges including a first hinge at one of top lateral edges of the panel and a second hinge at the other one of top lateral edges of the panel.

7. The collapsible wall of claim 6, wherein each of the hinges includes a male hinge member extending from one of the panel and at least one of the frame sections and a female hinge member defined in the other one of the panel and the at least one of the frame sections, the female hinge member being disengageable from the male hinge member at least when the panel is in the open position.

8. The collapsible wall of claim 1, wherein the panel is one of a plurality of panels of the collapsible wall, and each given panel of the plurality of panels is removably engaged to a given frame section of the plurality of frame sections.

9. A structure defining an opening therein and comprising the collapsible wall of claim 1 attached to the structure, the collapsible wall sized to cover at least a majority of the opening when the telescoping frame is in the extended position.

10. The structure of claim 9, comprising a recess defined in a top of the opening and being open downward into the opening, and wherein a top frame section of the plurality of frame sections is movable between a retracted position in which the top frame section is received at least in part within the recess, and an extended position in which the top frame section extends downward out of the recess into the opening.

11. The structure of claim 9, comprising a sheave system connecting the collapsible wall to the structure, the sheave system operable to move the telescoping frame between its extended position in which the collapsible wall covers at least the majority of the opening, and the retracted position in which the collapsible wall exposes at least another majority of the opening.

12. The structure of claim 9, wherein each frame section of the plurality of frame sections includes side seals slidably engaging respective lateral sides of the opening.

13. The structure of claim 12, wherein the side seals are biased toward the respective lateral sides of the opening.

14. The structure of claim 12, wherein at least one of the side seals includes arcuate portions slidably contacting a respective one of the lateral sides of the opening.

15. The structure of claim 12, wherein at least one of the side seals includes a movable member engaged to a respective side of a respective one of the frame sections via a biasing mechanism.

16. The structure of claim 9, comprising a recess defined in a bottom of the opening and being open upward into the opening, and wherein a bottom frame section of the plurality of frame sections is movable between a retracted position in which the bottom frame section is received at least in part within the recess, and an extended position in which the bottom frame section extends upward out of the recess into the opening.

17. The structure of claim 16, wherein in the extended position, the plurality of frame sections extend upward and cover at least a major part of the opening.

18. The structure of claim 9, wherein the plurality of frame sections forms a plurality of telescoping vertical assemblies, the plurality of telescoping vertical assemblies are independent telescoping vertical assemblies interconnected by the panels.

* * * * *